US005193998A

United States Patent [19]

Hack et al.

[11] Patent Number: 5,193,998

[45] Date of Patent: Mar. 16, 1993

[54] SEALING ARRANGEMENT FOR HEAT TREATMENT APPARATUS

[75] Inventors: Robert Hack, Lahnau; Jens Lindemann, Giessen; Erhard Netz, Hohenahr, all of Fed. Rep. of Germany

[73] Assignee: Arthur Pfeiffer Vakuumtechnik Wetzlar GmbH, Asslar, Fed. Rep. of Germany

[21] Appl. No.: 710,672

[22] Filed: Jun. 5, 1991

[30] Foreign Application Priority Data

Jun. 5, 1990 [DE] Fed. Rep. of Germany ..... 4017942

[51] Int. Cl.[5] ..... F23M 7/00

[52] U.S. Cl. ..... 432/250; 432/205; 110/173 R

[58] Field of Search ..... 110/173 R, 173 B, 173 C; 432/248, 250, 205, 252

[56] References Cited

U.S. PATENT DOCUMENTS

| | | | |
|---|---|---|---|
| Re. 18,668 | 11/1932 | Cope | 432/252 |
| 1,432,591 | 10/1922 | Carll | 110/173 R |
| 2,262,960 | 11/1941 | Osterman | 432/205 |
| 4,883,002 | 11/1989 | Schuster | 432/250 |

FOREIGN PATENT DOCUMENTS

| | | | |
|---|---|---|---|
| 0314946 | 5/1989 | European Pat. Off. | 432/250 |

*Primary Examiner*—A. Michael Chambers
*Attorney, Agent, or Firm*—Anderson Kill Olick & Oshinsky

[57] ABSTRACT

A heat treatment apparatus for vacuum and high pressure operation includes a container within a vessel separated by thermal insulation. The vessel has a door for access to the container. Both the container and thermal insulation have separate doors mounted on a common frame pivotally mounted inwardly of the vessel door. The container door can be opened and closed from otuside the vessel when the thermal insulation and vessel doors are closed. Normally the container door is kept open in case of failure of the closing mechanism or in the event of a power failure.

7 Claims, 2 Drawing Sheets

SEALING ARRANGEMENT FOR HEAT TREATMENT APPARATUS

BACKGROUND OF THE INVENTION

The present invention is directed to an arrangement for sealing a heat treatment apparatus comprises a vessel arranged for vacuum and high pressure operation. A container for the charge to be treated is located within the vessel with a heating device located about the container and thermal insulation enclosing the heating device and the container. Separate doors are arranged to close each of the vessel, the thermal insulation and the container.

Such an apparatus is used for sintering materials. The basic principle of a sintering plant for heat treatment of charges subjected to a vacuum with subsequent hot isostatic after treatment is disclosed in DE PS 30 14 619, DE OS 36 21 996 and in U.S. Pat. No. 4,398,702. A container forming the treatment space is located within a vessel arranged for vacuum and high pressure operation. The container is surrounded by a heating device. Insulation is installed between the heating device and the vessel for thermal shielding. Doors or covers are provided at one end of the container and at the corresponding ends of the thermal insulation and the vessel so that the container can be charged and discharged.

When the heat treatment in such an apparatus is completed, the treated charge must be cooled down. Rapid and effective cooling is required for economical and technological reasons, to keep the cycle time as short as possible. Cooling at higher pressure ranges is effected by convection. A more rapid cooling by gas circulation can be gained by opening the container door after treatment for obtaining a high conductance value. During such a procedure, however, good thermal insulation between the container and the vessel should be maintained, since the vessel wall among other reasons must be kept at a lower temperature for strength reasons. Accordingly, the insulation door should be kept closed during the cooling step.

In many sintering operations, the parts to be sintered are extruded or pressed together with binders, such as paraffin or polyethylene glycol or with thermoplastics, for imparting a sufficiently high basic strength to such parts, however, it is necessary to expel these binders prior to the sintering operation. Accordingly, the container door must remain closed, to prevent binder vapors from reaching the heating region and penetrating into the thermal insulation and impairing its effectiveness. A separate vapor line is provided between the container and an external condenser for aspirating the binder vapors.

When operating with compressed gas and when allowing compressed gas to enter, the container door must be kept open. This is necessary for safety reasons, since otherwise the container would be crushed by the pressure. Moreover, maintaining the container open assists in more rapid cooling, as pointed out above.

A closure or sealing device for heat treatment furnaces is set forth in DE GM 87 14 544 and serves for closing the exterior vessel, the thermal insulation and the container. This device has the disadvantage that the vessel door can only be opened along with the insulation door and the container door. As a result, control of the position of the closures or seals can only be effected with great difficulty or not at all. Another disadvantage is that the heat stresses occurring during the heat treatment process can be absorbed only with difficulty.

SUMMARY OF THE INVENTION

The primary object of the present invention is to provide a sealing arrangement in heat treatment apparatus for avoiding the above mentioned disadvantages, so that the door of the container can be opened and closed when the vessel and the insulation doors are closed. For safety reasons, the container door must remain in the open position in case of failure of the closure mechanism or if there is a power failure. Further, it must be possible to control the position of the container door from outside of the vessel. Heating stress can be compensated by the invention without any lost of functional ability.

In accordance with the present invention, means are provided for moving the container door and the insulation door between the open and closed positions independently of the vessel door. The means includes a first device for opening and closing the container door and a second device for opening and closing the insulation door independently of one another. Further, the means comprises a frame for supporting the first and second devices with the frame being movable between an open position and a closed position. In addition, the claims contain refinements of the invention.

In accordance with the present invention, it is possible to arrange the closure for the apparatus so that if there is a failure of the closure mechanism or of the power supply, the container is always in an open position and the insulation door in a closed position. The position of the container door can be controlled from outside the vessel.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
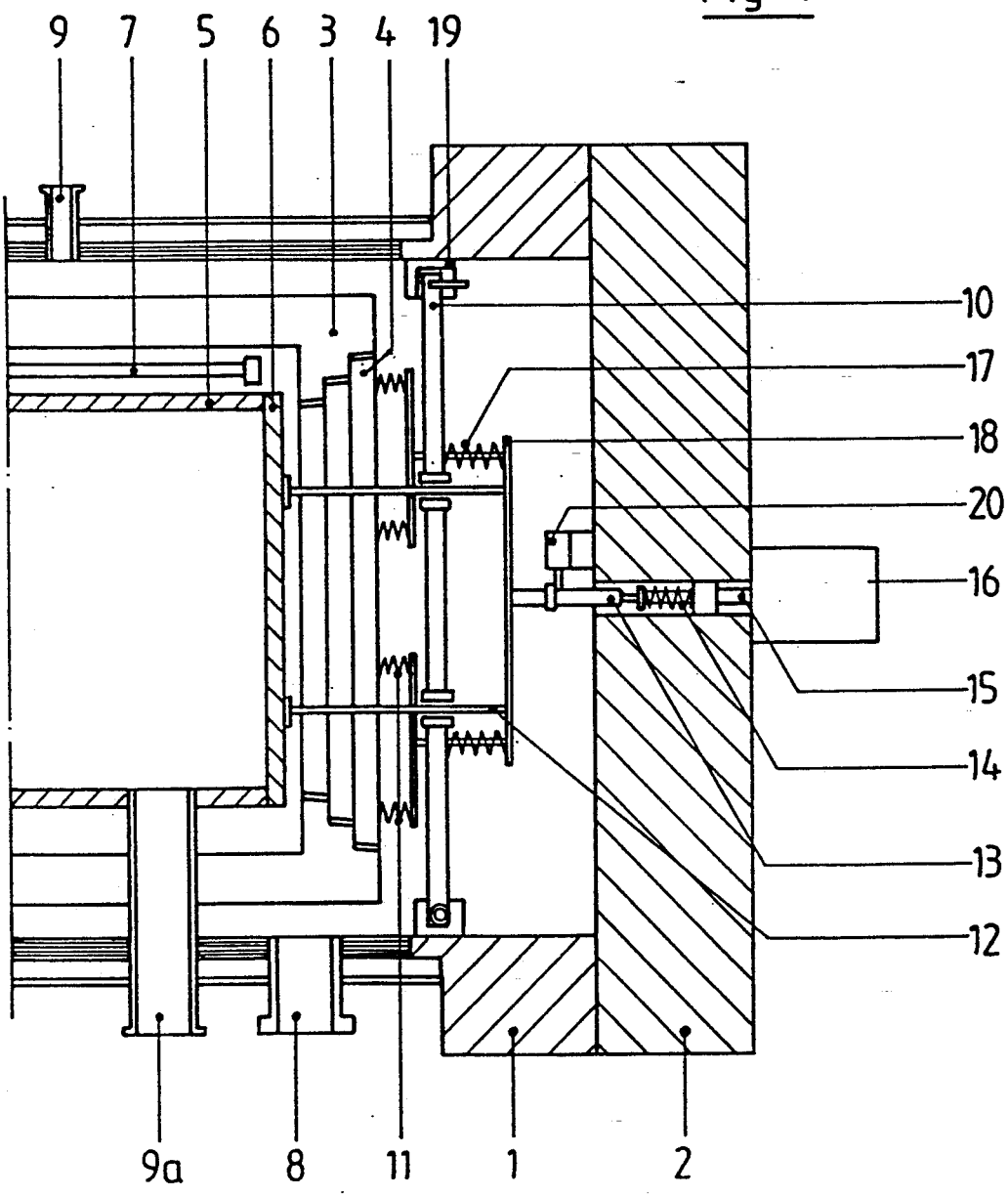
FIG. 1 is a partial sectional view through a heat treatment apparatus in the closed condition and embodying the present invention.
Figure 2:
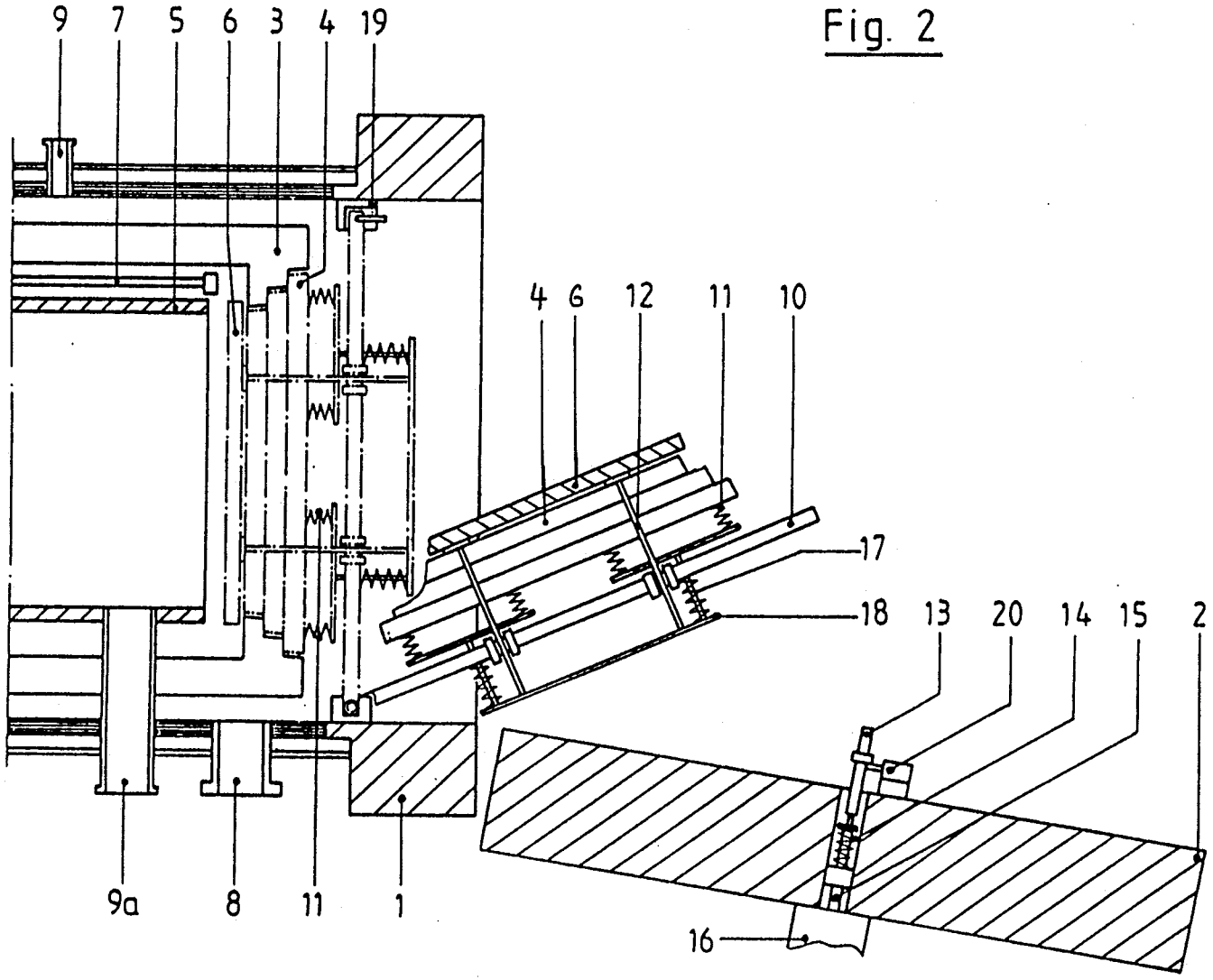
FIG. 2 is a view similar to FIG. 1, however, with the apparatus in the open condition and shown on a smaller scale.

In FIG. 1 an exterior vessel 1 is shown closed by a vessel door 2. Within the vessel 1 there is a container 5 with a closure door 6. The container 5 is enclosed by a heating device 7. Thermal insulation 3 is positioned between the heating device 7 and the inside of the vessel 1 to prevent the transmission of heat to the vessel. The insulation 3 is closed by an insulation door 4. Flanged passageways 8, 9 extend through the vessel 1 and provide connections for establishing a vacuum or producing high pressure. During sintering operation, binder vapors are drawn off through a line 9*a* into an external condenser, not shown.

A pivotally mounted frame 10 carrying the insulation door 4 is fastened to the inside wall of the tank 1. Frame 10 is pressed against the thermal insulation 3 by spring elements 11 which are fastened to the frame. A displacement device 12, also fastened to the frame 10, carries the door 6 for the container 5. Displacement device 12 is in contact with a driving device 16 by means of a transverse connector 18 via a tappet 13, a spring element 14 and a drive rod 15. Note that the tappet 13, the spring element 14 and the drive rod 15 are in alignment extending perpendicularly to the connector 18. There is no frictionally locked connection between the tappet 13 and the transverse connector 18 or between the tappet and the spring element 14. Spring elements 17 serve to open the container door 6. The spring element 14 serves to compensate for thermal expansion of the container 5 and, at the same time, provides the opposing force through the spring elements 17 to fix the position of the container door 6. After the container has been charged, the frame 10 along with the spring elements 11 are brought into the closed position secured by the locking device 19. As a result, the insulation door 4 is closed, while the vessel door 2 and the container door 6 remain open. A check can be made through the open vessel door 2 whether the insulation door 4 is tightly closed. Next, the vessel door 2 is closed. To close the container door 6 mechanical pressure is exerted on the transverse connector 18 by the drive 16 through the drive rod 15, the spring 14 and the tappet 13, with the tappet 13 moving into contact with the transverse connector, the spring elements 17 are compressed and the container door 6 is driven into the closed position.

To open the container door 6, the drive rod is pulled back by the driving device 16. Accordingly, the spring elements 17 are released through the transverse connector 18 the tappet 13 and the spring element 14 whereby the container cover 6 is opened.

Since the tappet 13 has no frictionally locked connection with the spring element 14 it moves back only when it is pressed in that direction by the spring elements 17 through the transverse connector 18. Since this operation is connected with the opening of the container cover 6, there is the possibility through the motion of the tappet 13 of controlling the open condition of the container door 6 by a switch 20 which signals the respective positions of the container door 6.

While specific embodiments of the invention have been shown and described in detail to illustrate the application of the inventive principles, it will be understood that the invention may be embodied otherwise without departing from such principles.

We claim:

1. A closure arrangement in a heat treatment device, comprising:

an outside vessel arranged for vacuum and higher pressure operation;

a container located within said vessel for receiving a charge to be treated;

a heating device located within said vessel and enclosing said container;

thermal insulation located within said vessel and surrounding said heating device and container, wherein said thermal insulation comprises a movable insulation door and a moveable door for sealing said container, wherein said vessel has an end with said vessel door located at the end, said insulation door and container door located inwardly of and adjacent the vessel door;

an openable pressure-tight door in said vessel for sealing the interior thereof;

means for moving said container door and insulation door between an open and a closed position independently of said vessel door, said means including a first device for opening and closing said container door, a second device for opening and closing said insulation door independently of one another and a frame supporting said devices and movable between an open position and a closed position;

a locking device, wherein said frame is pivotally mounted on said tank and is securable in the closed position by the locking device;

first spring elements mounted on said frame, wherein said first spring elements press said insulation door into the closed position when said frame is in the closed position;

a transverse connector extending in parallel relation with said frame and located between said frame and said vessel door;

second spring elements extending between said frame and said transverse connector;

displacement members connected to said transverse connection and said container door, and wherein said second spring elements are arranged to hold the container door in the open position;

a tappet arranged to contact said transverse connection and extending therefrom toward said vessel door;

a driving device located on the exterior of said vessel door;

a drive rod connected to said driving device and extending toward said tappet; and a third spring element located between said drive rod and said tappet for absorbing thermal stress in said container, wherein said driving device and the tappet act on the transverse connector for moving said container and door into the closed position.

2. The closure device of claim 1, wherein said first spring elements mounted on said frame press said insulation door into the closed position and retain the insulation door in the closed position free of external actuation.

3. The closure device of claim 1, wherein said container door is mounted on said frame by second spring elements for maintaining the container door in the open position free of external actuation.

4. The closure device of claim 3, wherein said means for closing the container door from a position exterior of the vessel door against the pressure of the spring elements.

5. The closure device of claim 3, wherein said means for opening the container door from a location exterior of the vessel door is free of a frictionally locked connection.

6. The closure device of claim 5, further comprising a switch located within said vessel in contact with said tappet wherein said switch indicates the open position of the container door and the switch is actuated by said tappet.

7. The closure device of claim 1, wherein said third spring element is positioned between said container door and said container device.

* * * * *